US009220648B2

(12) United States Patent
Hunt et al.

(10) Patent No.: US 9,220,648 B2
(45) Date of Patent: Dec. 29, 2015

(54) JACK STAND FOR A WHEELCHAIR

(71) Applicants: Blaine C. Hunt, San Marcos, CA (US); Calvin D. Hunt, Blanding, UT (US)

(72) Inventors: Blaine C. Hunt, San Marcos, CA (US); Calvin D. Hunt, Blanding, UT (US)

( * ) Notice: Subject to any disclaimer, the term of this patent is extended or adjusted under 35 U.S.C. 154(b) by 8 days.

(21) Appl. No.: 14/245,437

(22) Filed: Apr. 4, 2014

(65) Prior Publication Data

US 2015/0283011 A1 Oct. 8, 2015

(51) Int. Cl.
*A61G 5/02* (2006.01)
*A61G 5/10* (2006.01)

(52) U.S. Cl.
CPC . *A61G 5/104* (2013.01); *A61G 5/02* (2013.01)

(58) Field of Classification Search
CPC ..... A61G 5/104; A61G 5/02
See application file for complete search history.

(56) References Cited

U.S. PATENT DOCUMENTS 6,196,565 B1 * 3/2001 Chubbuck ..... 280/255
6,401,788 B1 * 6/2002 Sinclair ..... 157/1.1
6,455,869 B1 * 9/2002 Cook ..... 254/7 B
7,341,266 B2 * 3/2008 Bridges ..... 280/245
2003/0221303 A1 * 12/2003 Oleski ..... 29/273
2005/0199449 A1 * 9/2005 Tanksley et al. ..... 188/19
2006/0244227 A1 * 11/2006 Matsuda et al. ..... 280/47.25
2007/0296177 A1 * 12/2007 Porcheron ..... 280/250.1
2010/0148466 A1 * 6/2010 Richter et al. ..... 280/250.1
2013/0011231 A1 * 1/2013 Tekulve ..... 414/495
2013/0248786 A1 * 9/2013 Galla ..... 254/2 B

* cited by examiner

*Primary Examiner* — Kevin Hurley
*Assistant Examiner* — Gabriela C Craciun
(74) *Attorney, Agent, or Firm* — David B. Waller; Patent Success Strategies, LLC

(57) ABSTRACT

The present invention is a wheelchair jack stand that may be affixed to the seat post and main chassis member of a wheelchair to enable easy removal of the wheel. The jack stand comprises a lever arm retaining rail, a locking pin, a stand member and a second hub affixed to the base of the seat post for connecting the stand member. The lever arm retaining rail has apertures along its length for receiving a locking pin, a first end affixed to the seat post and a second end affixed to the main chassis member. The stand member has a first hub, a leg connected to the first hub and a lever arm connected to the first hub and opposite the leg. The lever arm also has one opening to receive a locking pin that aligns with the one or more apertures of the lever arm retaining rail. The angle between the leg and the lever arm is about 100 degrees.

18 Claims, 4 Drawing Sheets

JACK STAND FOR A WHEELCHAIR

CROSS-REFERENCE TO RELATED APPLICATIONS

Not applicable

STATEMENT REGARDING FEDERALLY SPONSORED RESEARCH OR DEVELOPMENT

Not applicable

THE NAMES OF THE PARTIES TO A JOINT RESEARCH AGREEMENT

Not applicable

INCORPORATION-BY-REFERENCE OF MATERIAL SUBMITTED ON A COMPACT DISC

Not applicable

TECHNICAL FIELD

The present invention relates to accessories and/or devices for a wheelchair. More specifically, a jack stand that may be affixed to a wheelchair that when activated allows easy removal of a wheel from the wheelchair when the chair is empty or occupied.

BACKGROUND OF THE INVENTION

A wide variety of different types of wheelchairs are produced to service the different needs of the user. These are often referred to as K-1, K-2, K-3, K-4, K-5, K-9, E1161, E1230, E1231, E1232, E1233, E1234, E1235, E1236, E1237, E1238, E1239 and E1240 wheelchairs based on the Medicare reimbursement K-code categories and Healthcare Common Procedure Coding System (HCPCS codes). A K-1 or K0001 wheelchair is a basic institutional wheelchair. These chairs generally have a non-adjustable steel frame construction, weighing approximately 41 to 45 pounds, and a seat to floor height of 19 to 21 inches. A K-2 or K0002 wheelchair is the same as the K-1 wheelchair with the exception of having a lower seat to floor height approximately 17 to 18 inches and shorter foot plate extension tubes. The K-3 or K0003 wheelchair is light weight ranging from 28 to 36 pounds with a seat to floor height of 19 to 21 inches and has a larger seat with size of approximately 20 inches as opposed to the standard 16 to 18 inch seat width. A K-4 or K0004 wheelchair is also light weight ranging from 26 to 34 pounds and has a number of frame adjustments that may be incorporated into the construction as well as an adjustable axle plate. These chairs are also available in a number of standard seat widths including 14, 16, 18 and 20 inches and have a variety of seat to floor heights ranging from 17 to 21 inches. K-5 or K0005 and K-9 wheelchairs are custom designed lightweight or ultra-lightweight wheelchairs. These wheelchairs are custom fit to the user and provide items such as an adjustable axle plate, rigid or folding construction, a variety of suspension types, a variety of castor size options for controlling turning radius on variable terrain, adjustable seat and back angles, different back height options, a variety of seat width and seat to floor heights ranging from 17 to 21 inches. These chairs can weight from 14 to 30 pounds depending on type of construction.

All of these types of wheelchairs provide the user with options for comfort during use. However, the location of the larger diameter rear wheel makes it difficult for the user to transfer from one wheelchair to another if needed. A number of unique wheelchair configurations have been developed to attempt to overcome this problem. One of these options raises the seat above the top of the larger diameter rear wheel. However, this raises the center of gravity of the wheelchair making it easier to tip over. Another option uses smaller diameter sized wheels. In some of these constructions all four wheels are of the smaller diameter size. Unfortunately, this can make it difficult for the user to traverse different types of terrain and can remove the user's ability to independently propel the wheelchair. Another provides removable side rails. Unfortunately this does not remove the larger diameter rear wheel from the transfer path.

Consequently, there is still a need in the industry for a wheelchair device that provides an unobstructed path when the user desires to transfer out of the wheelchair.

SUMMARY OF THE INVENTION

The present invention provides a wheelchair jack stand, methods of using the jack stand and a wheelchair comprising the jack stand. One aspect of the invention is a wheelchair jack stand that may be affixed to the seat post and main chassis member of a wheelchair to enable easy removal of the wheel. The jack stand comprises a lever arm retaining rail, a stand member and a second hub. The lever arm retaining rail has a first end affixed to a seat post of a wheelchair and a second end affixed to the main chassis member of the wheelchair. The retaining rail also has one or more apertures along its length for receiving a locking pin. The stand member has a first hub, a lever arm containing an opening to receive a locking pin connected to the first hub and a leg connected to the first hub wherein the angle between the leg and the lever arm is about 100 degrees. The opening on the lever arm aligns with one or more apertures of the lever arm retaining rail. The second hub is affixed to the base of the wheelchair seat post for connecting the first hub of the stand member.

Another aspect of the present invention is a wheelchair jack stand that may be affixed to a wheel spindle of a wheelchair to enable easy removal of the wheel. The jack stand has a first hub to be received by a wheel spindle of a wheelchair, a lever arm connected to the first hub and a leg connected to the first hub wherein the angle between the leg and the lever arm is about 170 degrees.

In one embodiment of the invention the wheelchair jack stand further comprises a first and second position lever arm retainer. The first position retainer is affixed to the seat post of a wheelchair to lock the jack stand in place for removing a wheel of a wheelchair. The second position retainer is affixed to the seat support member of the wheelchair to lock the jack stand in the stored position.

In another embodiment the leg of the wheelchair jack stand comprises two support members. Each of the two support members has a top end and a bottom end. The top end of each support member affixed to the first hub, one next to the other, and the bottom ends are separated by a distance of about 3 to about 12 preferably from about 5 to about 7 inches. A support strut may connect the two support members near the bottom ends to lend additional structural support.

In yet another embodiment the lever arm is bent at about 7 to about 30 degrees at a location about ⅓ to about ½ the length of said lever arm from said first hub. Preferably the lever arm is bent at about 10 to about 30 degrees at a location about ⅓ it length.

Another aspect of the present invention is a method for removing the wheel from a wheelchair to provide easy ingress and egress from said wheelchair. Method comprises the steps of affixing the jack stand described above to a wheelchair, moving the lever arm of the jack stand until its leg lifts the wheel above the ground and disconnecting and removing the wheel from the wheelchair.

Still another aspect of the present invention is a wheelchair comprising the jack stand described above.

DETAILED DESCRIPTION

Figure 1:
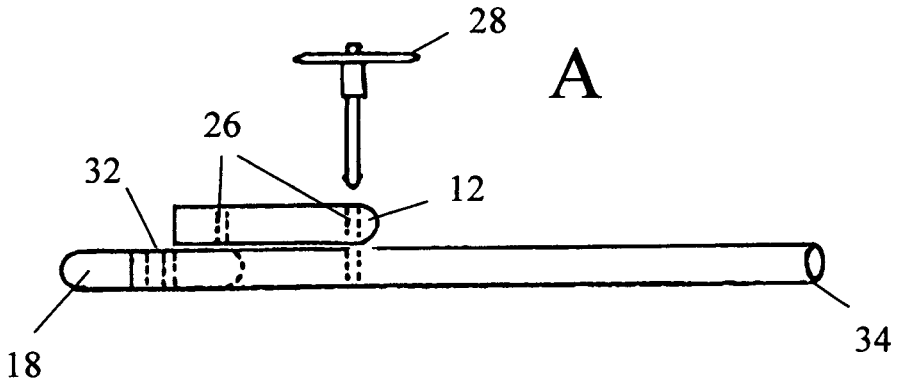
FIG. 1: is a diagrammatic representation of one jack stand of the present invention showing (A)' a top view of the jack stand and (B) a side view of the jack stand.
Figure 1:
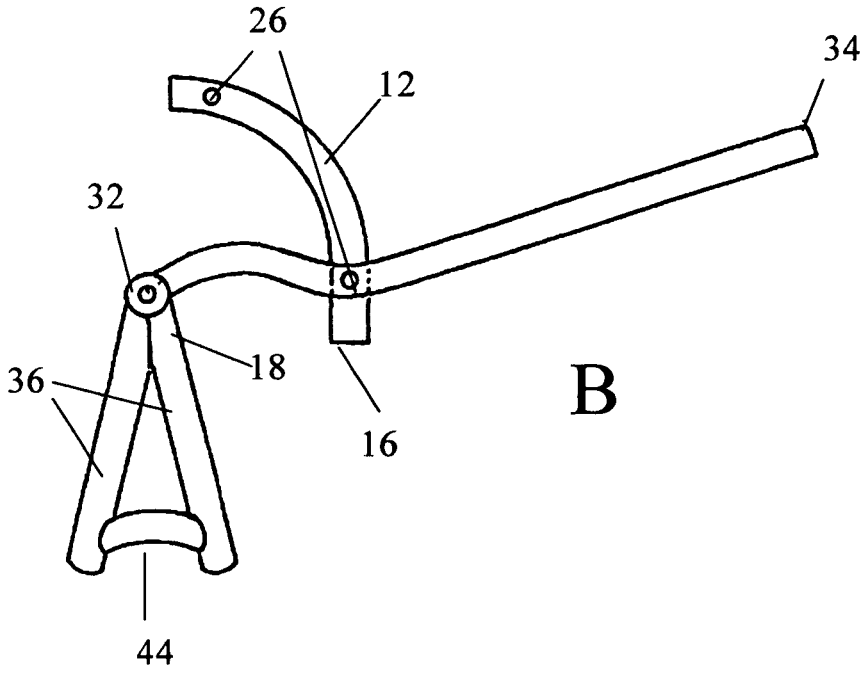

Unless defined otherwise, all terms used herein have the same meaning as are commonly understood by one of skill in the art to which this invention belongs. All patents, patent applications and publications referred to throughout the disclosure herein are incorporated by reference in their entirety. In the event that there is a plurality of definitions for a term herein, those in this section prevail.

The term "seat post" as used herein refers to the parallel tubular upright posts that support the seat back of the wheelchair, generally perpendicular to the ground forming handles on the top ends, the ends farthest from the ground, with its base affixed to the main chassis.

The term "main chassis" as used herein refers to the two parallel posts that are generally horizontal to the ground and are the posts that join the front and rear wheels on either side of the wheelchair and to which the set posts are affixed The term "support member" as used herein refers to the elements that comprise the leg of the stand member. When in contact with the ground, the stand member stabilizes the wheelchair and lifts the wheel adjacent to the support member off of the ground sufficiently to allow the wheel to be removed. The leg may comprise one or more support members. In some instances when the leg comprises multiple support members a support strut may be provided between the support members for additional strength and stability.

The term "affixed" as used herein refers to the attachment of an element of the invention to a wheelchair by a variety of methods known in the art that prevent the element from breaking free during normal use of the wheelchair. For example, if the wheelchair is made of steel tubing, an element of the invention may be affixed to the wheelchair by welding or brazing.

The term "connected" as used herein refers to the attachment of one element of the invention to another element of the invention. In some instances this term may be synonymous with the term affixing. However, this term also includes circumstance where one element is attached to another element because the two were formed or molded as a single part. For example, the stand member comprises a hub, a lever arm and a leg. Each of these elements may be affixed to form the stand member such as by welding or by being form molded as a single unified part such as by metal casting.

The term "wheel spindle" as used herein may be a rounded metal rod affixed to the wheelchair for mounting a wheel or it may be a bolt secured through a first hub provided on the wheelchair and through a second hub on a wheel. Each method secures the wheel rotatably on the wheelchair.

The present invention is a wheelchair jack stand that provides easy removal of a wheel of the wheelchair to allow the user to transfer easily from one wheelchair to another or from the wheelchair to another chair. The wheelchair jack stand comprises a lever arm retaining rail, a stand member and a second hub. The lever arm retaining rail has one or more apertures along its length for receiving a locking pin. The first end of the lever arm retaining rail is affixed to the seat post and the second end affixed to the main chassis member. The stand member has a first hub and a leg and lever arm connected to the first hub. The leg and the lever arm are connected to the first hub at an angle of about 100 degrees. The lever arm has at least one opening to receive a locking pin that aligns with one of the apertures of the lever arm retaining rail. The second hub is affixed to the base of the seat post for connecting the first hub of the stand member.

1. Lever Arm Retaining Rail

Figure 2:
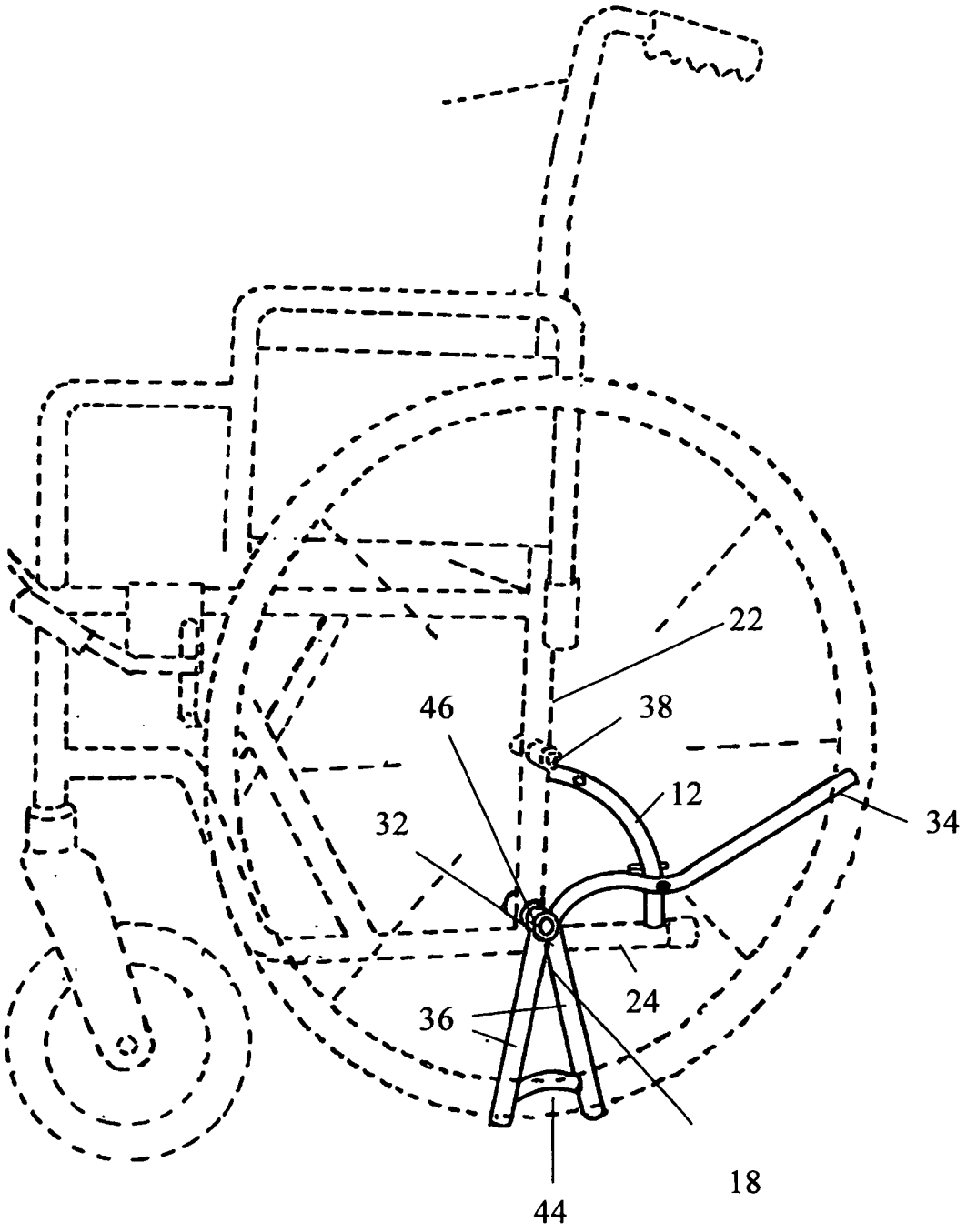
FIG. 2: Is a diagrammatic representation of the jack stand of FIG. 1 affixed to a wheelchair.

The lever arm retaining rail 12, also referred to as the "retaining rail" provides the adjustable securing points for the stand member 18. The retaining rail 12 may be prepared from a variety of structural tubing known in the art and in a variety of configurations. For example, the retaining rail 12 may be made of metal or high strength polymer. In a preferred embodiment, the retaining rail 12 is made of the same material as the seat post 22 and main chassis 24 (FIGS. 1A-B and 2).

The retaining rail 12 provides at least two adjustment apertures 26 one that locks the stand member 18 in an inactive stored position when not in use and one in an active securing the wheelchair and raising the wheel above the ground so that it can be easily removed. In this regard, a cylindrical tubular retaining rail 12 may be provided as a linear piece of tubing or may be formed into a semi-arc or one-quarter circular arc. In each of these configurations, the retaining rail 12 is positioned with one end 14 affixed to the seat post 22 and the other 16 affixed to the main chassis 24 (FIG. 2). In one embodiment the seat post 14, main chassis 24 and the retaining rail 12 are made of cylindrical tubular steel and the retaining rail 12 is affixed in place by welding.

The apertures 26 may be provided in a variety of shapes, sizes and configurations. Preferably the apertures 26 are circular in shape, but may be triangular, square or rectangular. The size will depend on the diameter of the pin 28 used to lock the stand member 18 in place. The diameter may vary depending on the material used to make the pin 28. High tensile strength materials may be utilized at a smaller diameter then those materials with less tensile strength. Preferable the pin 28 is made of solid stock material that is about 3/16 inch to about 3/8 inch in diameter. The pin 28 shape is preferably the same shape albeit slightly smaller diameter than the retaining rail apertures 26 so that the pin 28 may be easily inserted through the aperture 26. Alternatively pins that are commercially available may be utilized such as the Kwik-Lok quick release pin (Kwik-Lok Corp, Yakima, Wash.)

The aperture 26 may be drilled directly through the retaining rail 12 material providing a hole on either side of the tubular stock for receiving the pin 28. Alternatively, a sleeve may be inserted and affixed within the aperture 26 to more easily guide the pin 28 through the aperture 26. In the latter configuration, the sleeve may be affixed within the aperture 26 by a variety of methods. If the retaining rail 12 is made of cylindrical tubular steel, the sleeve may be welding in place within the aperture 26.

2. Stand Member

A. First Hub

The stand member 18 is comprised of a first hub 32, a lever arm 34 and a leg 36. The first hub 32 receives the wheel spindle 38 of the wheelchair or the bolt that secures the wheel to the wheelchair. The first hub 32 may be prepared from cylindrical tubular stock or may be form molded. In one embodiment the hub 32,46 is prepared from a cylindrical tubular stock in a length ranging from about ½ inch to about 2 inches. The lever arm 34 and the leg 36 are then affixed to the first hub 32. Preferably the first hub 32, lever arm 34 and leg 36 are prepared from the same material. The method of affixing these three elements will depend on the type of material from which they are constructed. For example, if the elements are made of cylindrical tubular steel they may be affixed by welding. Alternatively the stand member 18 may be form molded as a single element.

Other elements known to those skilled in the art may be utilized to allow the hub to rotate more easily. For example, the first hub 32 may comprise a bearing. A variety of wheel bearings types may be utilized including roller, ball or plain bearings.

B. Lever Arm

The lever arm 34 is a bar that extends from the first hub 32 at a specific distance that uses leverage created at this distance to reduce the amount of energy necessary to activate the jack stand 10 by engaging the leg 36 with the ground. The lever arm 34 may be prepared from a variety of materials that provide the required tensile strength to withstand the force created when activating the jack stand 10. Preferably, the lever arm 34 is made of a cylindrical tubular stock material. For example, the lever arm 34 may be made of a metal or a high tensile strength polymer. In one embodiment the lever arm 34 is made of the same material as the first hub 32. The method of affixing the lever arm 34 to the first hub 32 will depend on the type of material from which these two elements are prepared. For example, if the elements are made of steel then they may be affixed by welding. Alternatively, it may be desire to reduce the weight of the stand member 18. In this embodiment, a tubular sleeve having a length of about 1 inch to about 2 inches is affixed to the first hub 32. For example, if the sleeve and the hub 32, 46 are made of steel they may be affixed by welding. In this example the lever arm 34 may be made of an ultra-light weight material such as carbon fiber having one end configured to be received within the sleeve.

The lever arm 34 may also be provided with a handle or textured surface that allows the user to securely grip the lever arm 34 when activating the stand member 18 For example, a non-slip polymer sleeve may be secured to the end of the lever arm 34. Other similar devices known to those skilled in the art may be used to achieve this purpose.

Depending on the position of the lever arm 34 on the hub 32, the arm 34 may be straight or configured to avoid contact with elements of the wheelchair or provide greater ease in use. For example, the jack stand 10 the lever arm 34 may be bent slightly (see FIGS. 1B and 3B) to create greater force when using the lever to activate the jack stand 10. In addition, the lever arm 34 may be bent slightly to avoid contact with the horizontal lateral members forming the seat (see FIG. 3C).

C. Leg

The leg 36 provides the support to secure the wheelchair when the jack stand 10 is activated and raising the wheelchair sufficiently to allow easy removal of the wheel. The leg 36 may be provided in a variety of configuration to achieve this goal. The leg may be a single bar extending from the first hub having an elongated base for contacting the ground and providing stability. For example, the leg 36 may be configured in an upside down "7". Alternatively, the leg 36 may have two or more elements that extend from the first hub 32 and are separated by a distance of about 2 inches to about 10 inches and are of the same length where they contact the ground. In one embodiment, the leg 36 comprises two elements. In another embodiment, the two elements have a support strut 44 that connects the two elements near where they contact the ground.

The leg 36 may also be made of a variety of materials such as metal or high tensile strength polymer. It may be form molded as one piece with the hub 32 and the lever arm 34 or it may be prepared independently and affixed to the hub 32. Preferably, the leg 36 is made of the same material as the hub 32. The method of affixing will depend on the type of material from which the leg 36 and hub 32 are prepared. For example, if the leg 36 and the hub 32 are made of steel then they may be welded. If a support strut is utilized it is preferable that it be made of the same material as the leg 36. Consequently, if the leg 36 and the support strut 44 are made of cylindrical tubular steel they may be affixed by welding.

The angle created between the lever arm 34 and the leg 36 will depend on the location where the jack stand 10 is activated. For example, if the jack stand 10 is configured so that it may be activated from the back of the wheelchair this angle is from about 90 degrees to about 130 degrees. If the jack stand 10 is to be activated by the user this angle is much greater ranging from about 150 degrees to 180 degrees.

Further, additional stability can be achieved if the lever arm 34 and the leg 36 are not perpendicular to the hub 32. In one embodiment, the lever arm 34 and the leg 36 are angled slightly from perpendicular to the hub 32 by about 3 degrees to about 10 degrees (see FIG. 3C).

3. Second Hub

Figure 3:
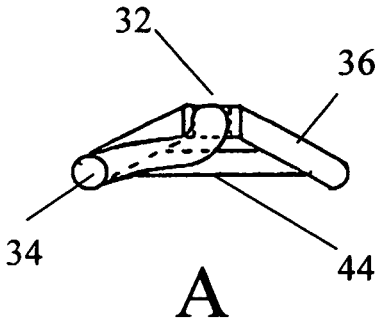
FIG. 3: Is a diagrammatic representation of another jack stand of the present invention showing (A) a top view of the jack stand, (B) a front view of the jack stand in and (C) a side view of the jack stand.
Figure 3:
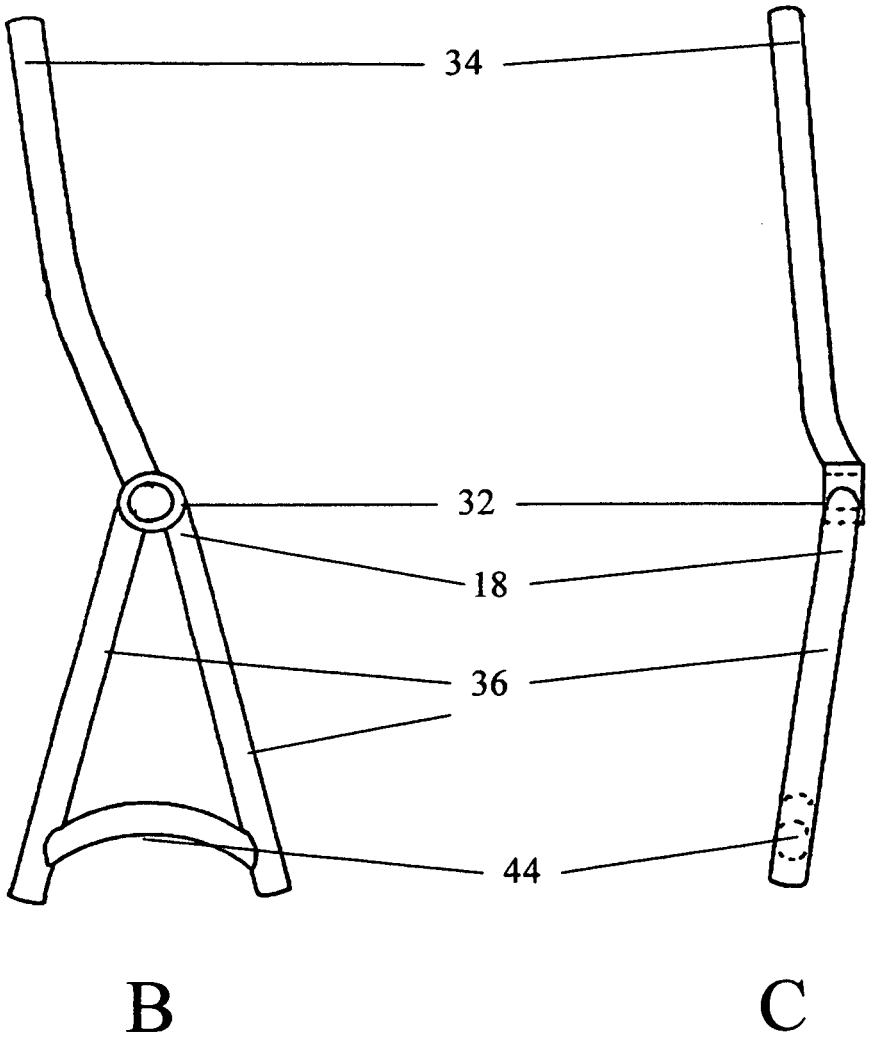
Figure 4:
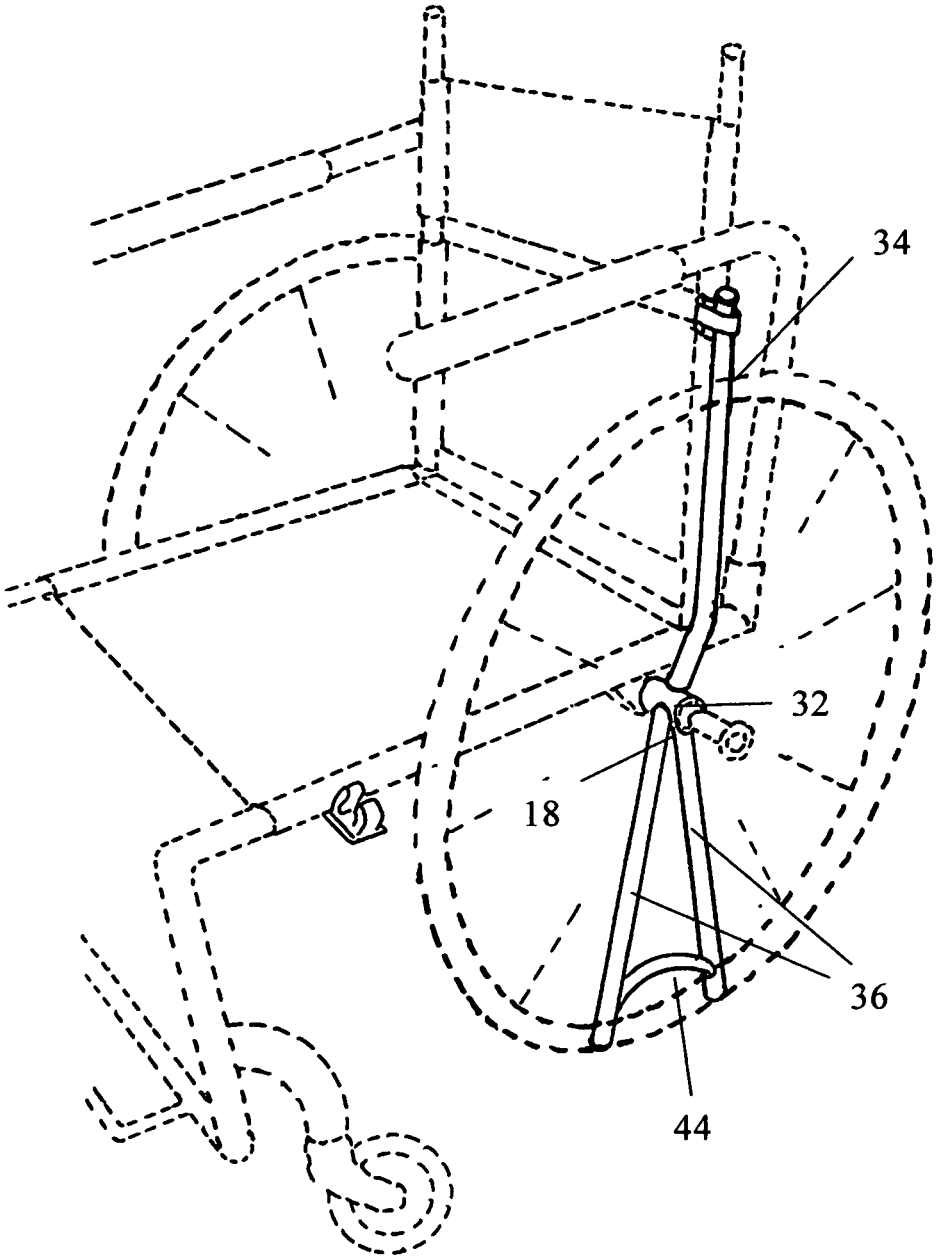
FIG. 4: Is a diagrammatic representation of the jack stand of FIG. 3 affixed to a wheelchair.

The second hub 46 provides attachment for the stand member 18 when it is not affixed to the wheel spindle 38 of the wheelchair (FIGS. 3A-B and 4). The second hub 46 may be prepared from cylindrical tubular stock or may be form molded. In one embodiment the hub 46 is prepared from a cylindrical tubular stock in a length ranging from about ½ inch to about 3 inches. The length will depend on the diameter of the cylindrical tubular stock used in making the seat posts 22 of the wheelchair and the distance the wheel and/or wheel spokes are positioned from the seat posts 22. This hub 46 may be secured to or within the seat post 22. If secured to the seat post 22 it may be positioned up against the seat post 22 along the main chassis 24 or within 3 inches on either side of the sear, post 22 and on the main chassis 24. If secured within the seat post 22 the hub 46 will have a diameter that is less than the diameter of the cylindrical tubular stock used to prepare the seat post. In any of these configurations the hub 46 may be affixed to the seat post 22 and/or the main Chassis 24 by a variety of methods. If the hub 46, seat post 22 and main chassis 24 are made of steel cylindrical tubular stock, the hub 46 may be affixed by welding.

Other elements known to those skilled in the art may be utilized to allow the hub to rotate more easily. For example, the second hub may comprise a bearing. A variety of wheel bearings types may be utilized including roller, ball or plain bearings.

Assembly

The stand member of the present invention may be provided as a single form molded piece or may be prepared by affixing the lever arm and leg to the first hub in one or more of the configurations previously disclosed.

The type of jack stand used will depend on the desires and/or capabilities of the user. If the user desires to be pushed or is incapable of providing the power necessary to propel the wheelchair, then a jack stand that may be operated by other than the user would be preferable. Under these circumstances the user would be selecting a wheelchair in the K code categories of K-1 through K-3. Alternatively, if the user will be utilizing the wheelchair unassisted and under his/her own power, then a jack stand that is operable by the user is preferable. Under this circumstance, the user will likely select a wheelchair from the K code categories of K-4 and K-5.

If the user will be assisted and selects, for example, a K-1 wheelchair, then the jack stand may be assembled on the wheelchair by first affixing the lever arm retaining rail and second hub to the rear of the wheelchair. The lever arm is affixed with one end securely connected to the seat post and one end connected to the main chassis where the seat post and main chassis are connected. The second hub may be affixed in a variety of ways. In one configuration hole having a diameter slightly larger than the exterior diameter of the second hub is drilled near the place where the seat post and the main chassis are connected. The second hub is then inserted and affixed within this hole. Alternatively the hub may be affixed on either side of the seat post where the seat post and main chassis are connected. Other configurations that would be obvious to those skilled in the art may also be utilized.

Once the lever arm retaining rail and second hub are securely affixed to the wheelchair the stand member is rotatably attached to the second hub. In one example, this may be accomplished with a nut and bolt.

If the user will be utilizing the wheelchair under his/her own power and selects, for example a K-5 wheelchair, then the jack stand may be connected to the wheelchair by first inserting a camber tube insert, an element made of machined metal that slides is secured into the axle cross tube for each wheel which provides the surface necessary to support the hub of the stand member. Once these have been secured to the axle's cross tubes, the stand member is inserted onto the camber tube and the wheel replaced.

Use

When the user desires to move from the wheelchair to another wheelchair or chair, the jack stand is activated so that the wheel can be removed providing an unobstructed transfer space. If the user is utilizing a K-1 wheelchair then the assistant activates the jack stand from behind the chair pushing down on the lever arm until the leg is securely positioned lifting the wheel sufficiently off the ground for easy removal. If the user is utilizing a K-5 wheelchair, then the user pulls upward on the lever arm until the leg is securely positioned lifting the wheel sufficiently off the ground for easy removal. In addition, a first and second position brackets may be connected to the wheelchair to secure the lever arm in both the activated and stored positions. For example, in the stored position a clip bracket connected to the seat support member to maintain the lever arm generally parallel to the ground. In the activated position a nylon strap or other mechanical device connected to the seat post may be used to maintain the lever arm generally perpendicular to the ground.

What is claimed:

1. A wheelchair jack stand to be affixed to a seat post and a main chassis member of a wheelchair to enable easy removal of a wheel from said wheelchair, said jack stand comprising:

a. a lever arm retaining rail having a first and second ends, said first end affixed to said seat post and said second end affixed to said main chassis member, wherein said retaining rail has one or more apertures along its length for receiving a locking pin;

b. a stand member having a first hub, a lever arm connected to said first hub having one opening to receive a locking pin and a leg connected to said first hub wherein the orientation of said lever arm to said leg forms an angle, said angle being about 100 degrees, wherein said one opening aligns with said one or more apertures of said lever arm retaining rail; and c. a second hub affixed to said seat post for connecting said first hub of said stand member.

2. A wheelchair jack stand to be affixed to a wheel spindle of a wheelchair to enable easy removal of a wheel from said wheelchair, said jack stand comprising: a first hub to be received by said wheel spindle, a lever arm connected to said first hub and a leg connected to said first hub wherein the orientation of said lever arm to said leg forms an angle, said angle being about 170 degrees.

3. The wheelchair jack stand according to claim 2, further comprising a first and second position lever arm retainer, said first position retainer affixed to a seat post of said wheelchair to lock said jack stand in place to remove a wheelchair wheel said second position retainer affixed to a seat support member of said wheelchair to lock said jack stand in the stored position.

4. The wheelchair jack stand according to claim 1, wherein said leg comprises two support members each of said two support members having a top end and a bottom end, said top end of each support member affixed to said first hub, one next to the other, wherein said bottom ends are separated by a distance of about 3 to about 5 inches.

5. The wheelchair jack stand according to claim 2, wherein said leg comprises two support members each of said two support members having a top end and a bottom end, said top end of each support member affixed to said hub, one next to the other, wherein said bottom ends are separated by a distance of about 7 to about 12 inches.

6. The wheelchair jack stand according to claim 4, wherein said leg further comprises a support strut affixed near said bottom ends of each of said two support members.

7. The wheelchair jack stand according to claim 5, wherein said leg further comprises a support strut affixed near said bottom ends of each of said two support members.

8. The wheelchair jack stand according to claim 1, wherein said lever arm is bent at about 10 to about 30 degrees at a location about ⅓ to about ½ the length of said lever arm from said first hub.

9. The wheelchair jack stand according to claim 2, wherein said lever arm is bent at about 7 to about 30 degrees at a location about ⅓ the length of said lever arm from said hub.

10. A wheelchair with a jack stand, to be affixed to a seat post and a main chassis member of a wheelchair to enable easy removal of a wheel from said wheelchair, said jack stand comprising:

a. a lever arm retaining rail having a first and second ends, said first end affixed to said seat post and said second end affixed to said main chassis member, wherein said retaining rail having one or more apertures along its length for receiving a locking pin;

b. a stand member having a first hub, a lever arm connected to said first hub having one opening to receive a locking pin and a leg connected to said first hub wherein the orientation of said lever arm to said leg forms an angle, said angle being about 100 degrees, wherein said one opening aligns with said one or more apertures of said lever arm retaining rail; and c. a second hub affixed to said seat post for connecting said first hub of said stand member.

11. A wheelchair with a jack stand, said jack stand comprising: a hub to be received by a wheel spindle of said wheelchair, a lever arm connected to said hub and a leg connected to said hub wherein the orientation of said lever arm to said leg forms an angle, said angle being about 170 degrees.

12. The wheelchair with a jack stand according to claim 11, wherein said jack stand further comprising a first and second position bracket, said first position bracket affixed to a seat post of said wheelchair to lock said jack stand in place to remove a wheelchair wheel said second position bracket affixed to a seat support member of said wheelchair to lock the jack stand in the stored position.

13. The wheelchair with a jack stand according to claim 10, wherein said jack stand leg comprises two support members each of said two support members having a top end and a bottom end, said top end of each support member affixed to said first hub, one next to the other, wherein said bottom ends are separated by a distance of about 3 to about 8 inches.

14. The wheelchair with a jack stand according to claim 11, wherein said jack stand leg comprises two support members each of said two support members having a top end and a bottom end, said top end of each support member affixed to said hub one next to the other wherein said bottom ends are separated by a distance of about 7 to about 12 inches.

15. The wheelchair with a jack stand according to claim 13, wherein said jack stand leg further comprises a support strut affixed near said bottom ends of each of said two support members.

16. The wheelchair with a jack stand according to claim 14, wherein said jack stand leg further comprises a support strut affixed near said bottom ends of each of said two support members.

17. The wheelchair with a jack stand according to claim 10, wherein said jack stand lever arm is bent at about 7 to about 30 degrees at a location about ⅓ to about ½ the length of said lever arm.

18. The wheelchair with a jack stand according to claim 11, wherein said jack stand lever arm is bent at about 7 to about 30 degrees at a location about ⅓ the length of said lever arm.

* * * * *